US005396936A

United States Patent [19]

Nalbach et al.

[11] Patent Number: 5,396,936

[45] Date of Patent: Mar. 14, 1995

[54] MEASURING FLASK FOR USE IN A FILLING MACHINE

[75] Inventors: John C. Nalbach, Oak Brook; Graeme W. Warner, Hinsdale, both of Ill.

[73] Assignee: John R. Nalbach Engineering Co., Inc., Cicero, Ill.

[21] Appl. No.: 271,984

[22] Filed: Jul. 8, 1994

[51] Int. Cl.[6] ..... B65B 1/22

[52] U.S. Cl. ..... 141/144; 141/147; 141/374; 141/83; 141/148; 222/367

[58] Field of Search ..... 141/83, 144–152, 141/163, 177, 181, 182, 250, 251, 263, 374, 392; 222/346, 367, 370

[56] References Cited

U.S. PATENT DOCUMENTS

| | | | |
|---|---|---|---|
| 3,554,412 | 1/1971 | Hayashi et al. | 141/144 X |
| 3,826,294 | 7/1974 | Rademaeher | 141/147 X |
| 3,967,659 | 7/1976 | Warner et al. | 141/148 X |
| 3,967,662 | 7/1976 | Warner | 141/148 |
| 4,122,876 | 10/1978 | Nalbach | 141/177 X |
| 4,915,146 | 4/1990 | Warner | 141/144 |
| 5,022,443 | 6/1991 | Warner | 141/144 |
| 5,040,574 | 8/1991 | Petri et al. | 141/147 X |
| 5,095,960 | 3/1992 | Grundler et al. | 141/147 X |
| 5,320,146 | 6/1994 | Stevie | 141/144 X |

*Primary Examiner*—Ernest G. Cusick
*Attorney, Agent, or Firm*—Anthony S. Zummer

[57] ABSTRACT

An improved filling machine is used for filling like containers with a like measured amount of divided material. The filling machine includes a housing and a drive connected to the housing. A filling turret is mounted in the housing. The filling turret includes a filling tank with a rotatable floor connected to the drive. A plurality of measuring flasks is arranged in a circle in the rotatable floor. Each measuring flask includes an open ended measuring tube and a sleeve telescopically mounted on the tube. The measuring flasks receive divided material from the filling tank. A container support maintains the containers in a horizontal plane. A control selectively lowers and raises the sleeve relative to the respective tube as the containers move with the flasks to measure the amount of divided material to be delivered to the respective container and then deliver the measured divided material into the container.

20 Claims, 7 Drawing Sheets

MEASURING FLASK FOR USE IN A FILLING MACHINE

BACKGROUND OF THE INVENTION

Automated machines for filling containers with flowable powdered or granular material are well known and generally accepted in many industries for packaging goods. The powdered or granular materials include, as an example, a broad range of food materials, including but not limited to, milk products, condiments, tea, coffee, sugar, cocoa, rice, seeds and the like, as well as, a line of chemicals, including but not limited to, cleaners, lyes, crystals, and the like. Machines of this general type are disclosed in: U.S. Pat. No. 3,967,662, entitled, "Container Filling Apparatus", issued Jul. 6, 1976; U.S. Pat. No. 4,915,146, entitled, "Measuring Flask For Use In A Filling Machine" issued Apr. 10, 1990; and U.S. Pat. No. 5,022,443, entitled, "Measuring Flask Construction For Use In A Filling Machine", issued Jun. 11, 1991, Graeme W. Warner of Hinsdale, Ill. is the patentee of each of the aforementioned patents. The filling machines disclosed in the three mentioned patents have one characteristic in common, wherein a plurality of containers enter the filling machines serially and each container is aligned with a respective measuring flask. The container is raised so that the bottom of the container engages the bottom of a filling flask. A fill material is delivered to a measuring tube of the measuring flask. The container is then lowered away from the measuring flask, so that the fill material discharges from the measuring flask into the respective container. The raising and lowering of each container places a limitation on the speed of operation of the filling machine. The amount of fill material which is delivered to each container is determined largely by the size of the measuring tube which is fixed. An adjustment of the amount of material delivered to the containers is not easily made.

It is desirable to provide a filling machine wherein the amount of fill material delivered is easily adjusted. The containers which are the receptacles for fill material need not be moved vertical to improve the speed of operation. Elimination of vertical movement of the containers provides for more gentle handling of the containers. Additionally, the holder parts which hold the containers are simpler and less expensive than those in the prior art machines, and the holder parts may be easily changed to accommodate containers of different sizes.

SUMMARY OF THE INVENTION

The present invention relates to an improved filling machine for filling each container with a like measured amount of divided material. The filling machine includes a housing with a drive mounted in the housing. A filling turret is mounted in the housing. The filling turret has a rotatable portion connected to the drive and is rotated thereby. The filling turret includes a filling tank. The filling tank has a rotatable floor connected to the drive to be rotated thereby. A plurality of measuring flasks is mounted on the rotatable floor. The flasks are arranged in a circle concentric with the rotation path of said rotatable portion of the filling turret. Each of the measuring flasks is connected to the rotatable floor of the filling tank for receiving divided material from the filling tank and measuring that material. Each of the measuring flasks includes an open ended elongated measuring tube having one end connected to the rotatable floor for receiving divided matter from the filling tank, and the other end of the tube extends downward. Each measuring tube has its length substantially parallel to the axis of rotation of the rotatable floor. A sleeve is telescopically mounted on each open ended tube and is movable axially along the length of its respective tube. Each of said sleeves has its lower end engageable with the interior of a bottom of a container, which container is a receptacle for a measured amount of divided matter. A container support is mounted in a filling turret below the measuring flasks. The container support is in a substantially horizontal plane for holding a plurality of containers on the same plane. Means connected to the drive align each container with a respective measuring flask and move the containers on the container support in a circular path having its center on a vertical axis coincidental with the axis of rotation of the rotatable floor. Control means position each sleeve relative to a respective container while the container moves in its circular path in a horizontal plane. The control means includes means holding each sleeve in a raised position above the respective container during movement of the container in a selected portion of the circular path and includes means for lowering each sleeve into its respective container during movement of the container in another selected portion of the circular path. The control means includes means for raising each sleeve out of the respective container to allow divided matter to discharge into the respective container during movement of the respective container in still another selected portion of the circular path.

DESCRIPTION OF THE PREFERRED EMBODIMENT

Figure 1:
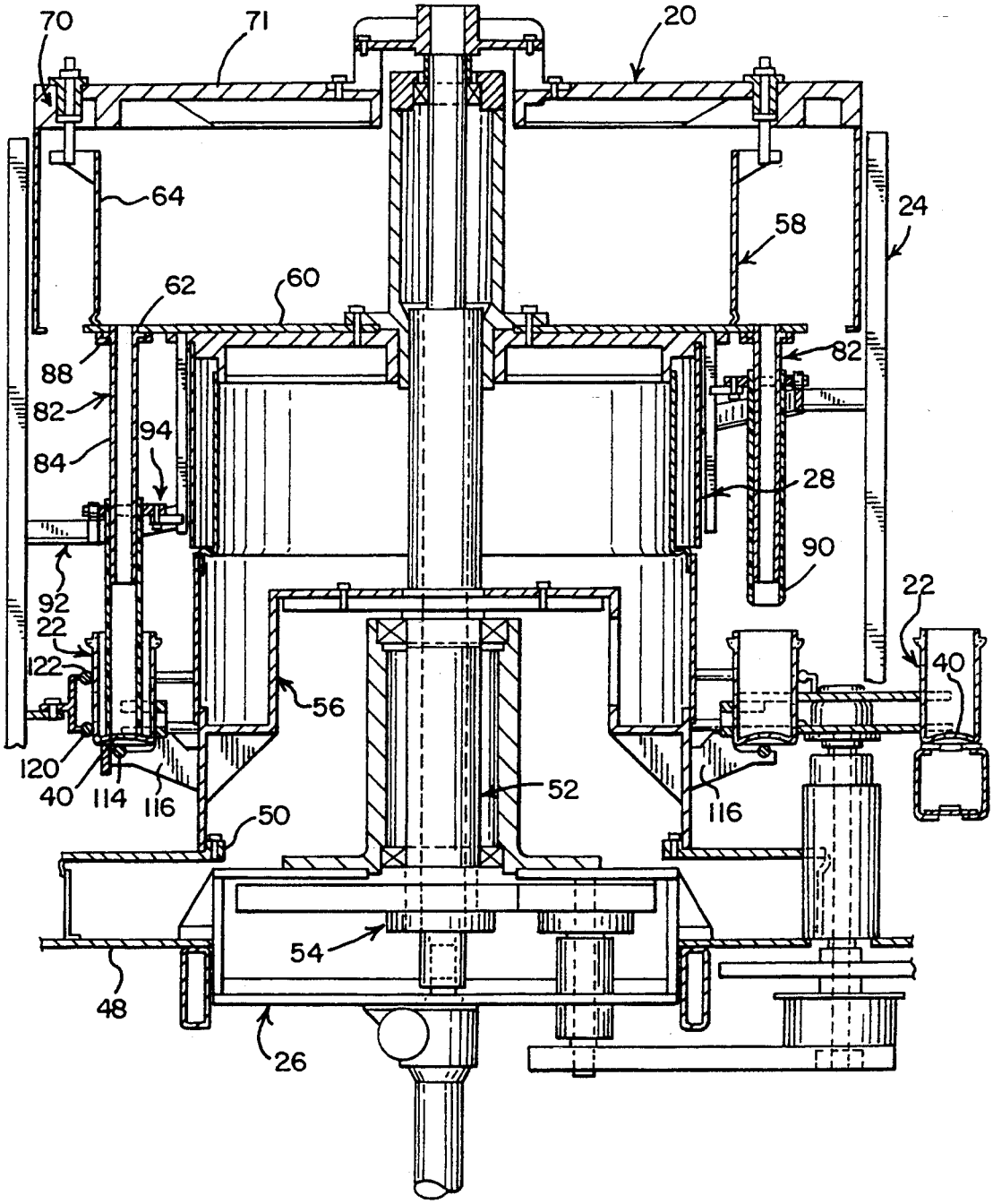
FIG. 1 is a cross sectional elevational view of a filling machine embodying the herein disclosed invention.
Figure 8:
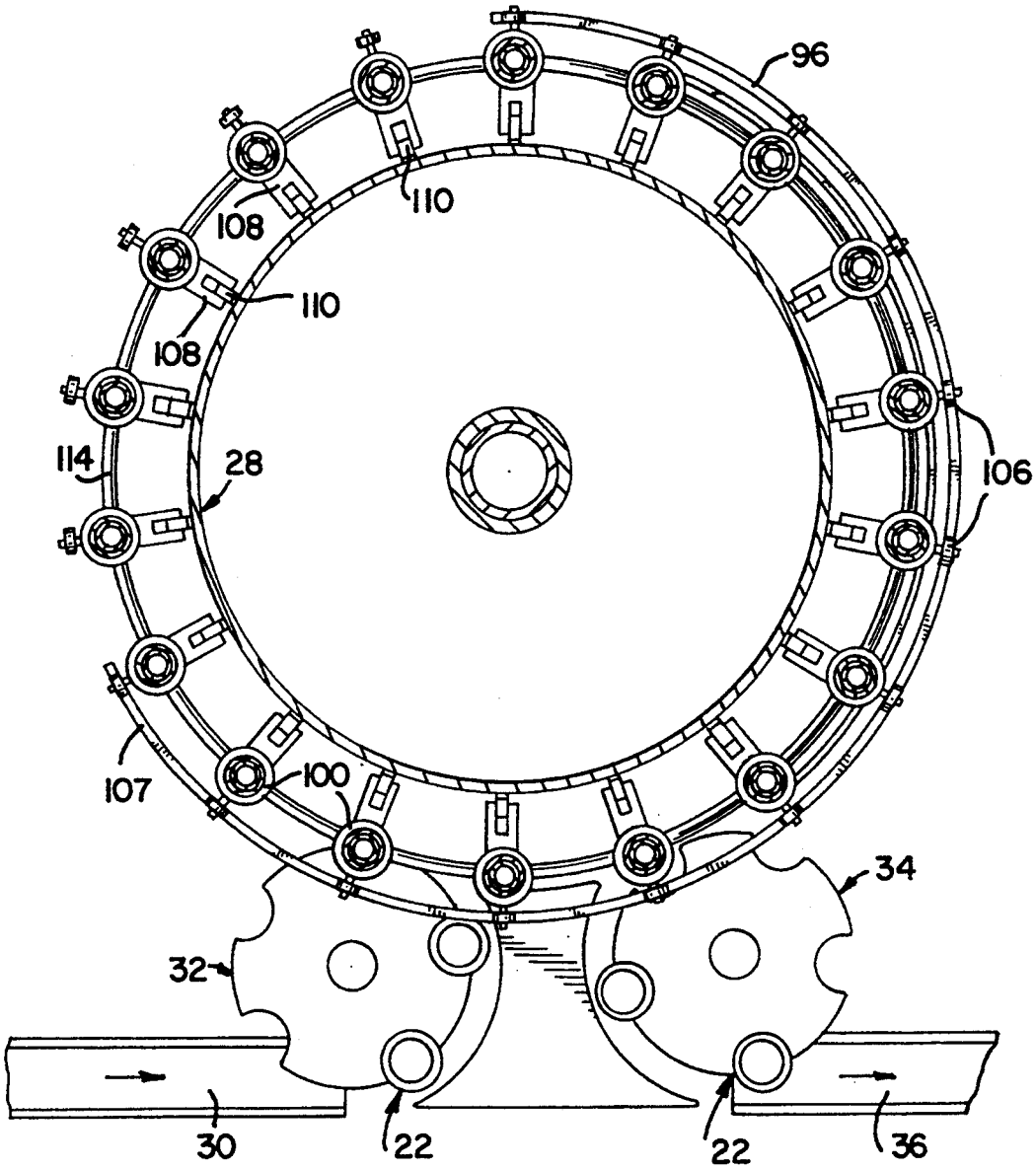
FIG. 8 is a cross sectional plan view showing the interrelationship of containers entering the filling machine and filled containers leaving the filling machine.
Figure 10:
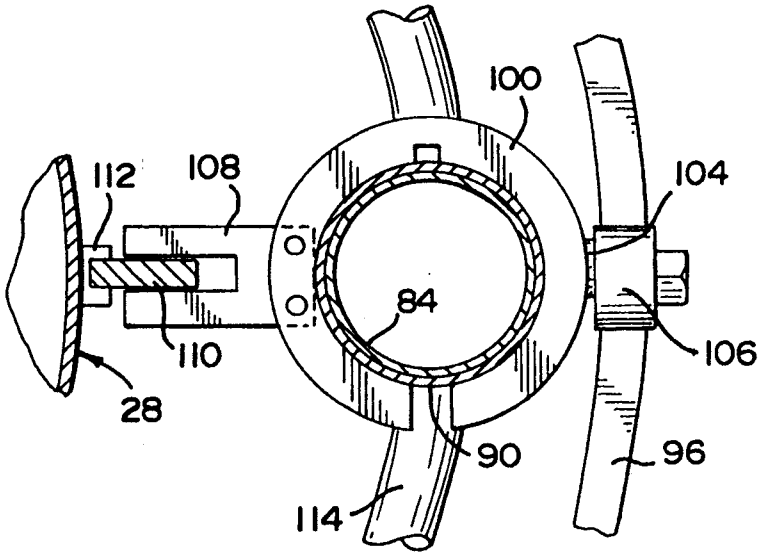
FIG. 10 is a cross sectional view through a measuring flask showing the interrelationship of a control means and a guide for a sleeve of the measuring flask.
Figure 9:
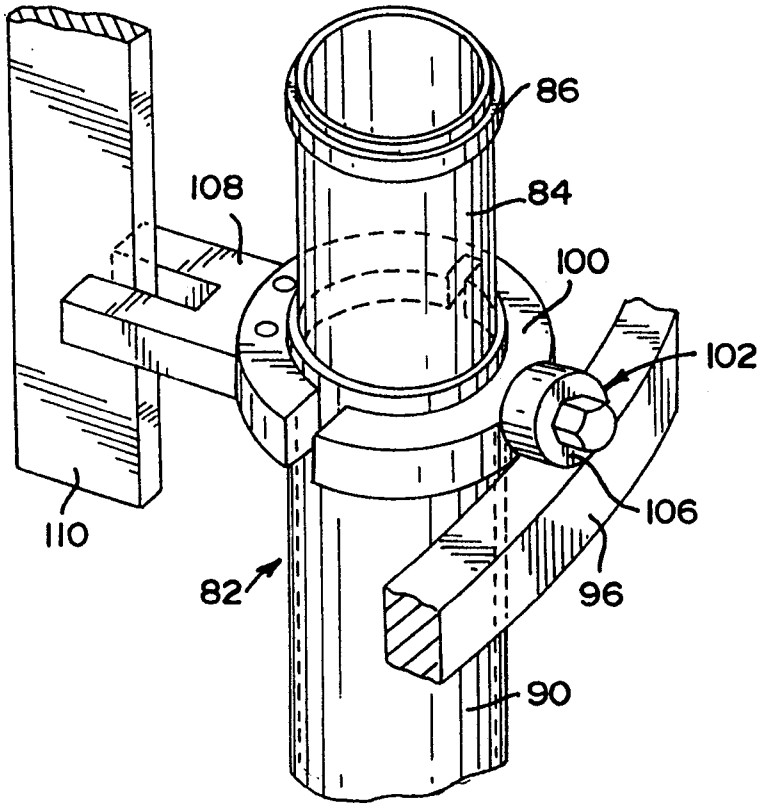
FIG. 9 is an enlarged fragmentary perspective view showing the interrelationship of a sleeve with a measuring tube and a cam for moving the sleeve axially along its respective measuring tube and a guide to keep the sleeve in an attitude for connection to the cam.

Referring now to the drawings and especially to FIG. 1, a filling machine, generally indicated by numeral 20, is a specific embodiment of the herein disclosed invention. The herein disclosed filling machine 20 is particularly adapted for filling containers 22 with granular or powdered material. Filling machine 20 generally includes an apparatus housing 24 with a conventional drive assembly 26 mounted in the lower portion of the housing. A filling turret 28 is mounted in the housing and is connected to the drive assembly. As may be best seen in FIG. 8, an infeed conveyor 30 delivers containers 22 to an infeed turret 32, which in turn delivers the containers to filling turret 28. An output turret 34 removes filled containers from the filling turret and delivers the filled containers to an output conveyor 36.

Each container 22 is conventional and is identical to each other container 22. In this instance, the conventional containers are glass containers; however, the containers may be of any suitable material, such as, plastic or tin plate. Each of the containers 22 has a domed bottom 40 and a continuous cylindrical side wall 42 formed integral with the domed bottom. A lip 44 is formed integral with the outer periphery of cylindrical side wall 42 adjacent to the upper edge thereof. The container has a conventional open mouth 46. Housing 24 generally includes a drive floor 48 which contains an aperture 50 to receive a part of the drive assembly 26. Drive assembly 26 is connected to a conventional variable speed electric motor which is not shown herein. The motor is connected to a drive shaft 52 which is in turn drivingly connected to a gear drive assembly 54. A drum 56 is connected to drive shaft 52 and encloses the drive assembly.

Figure 6:
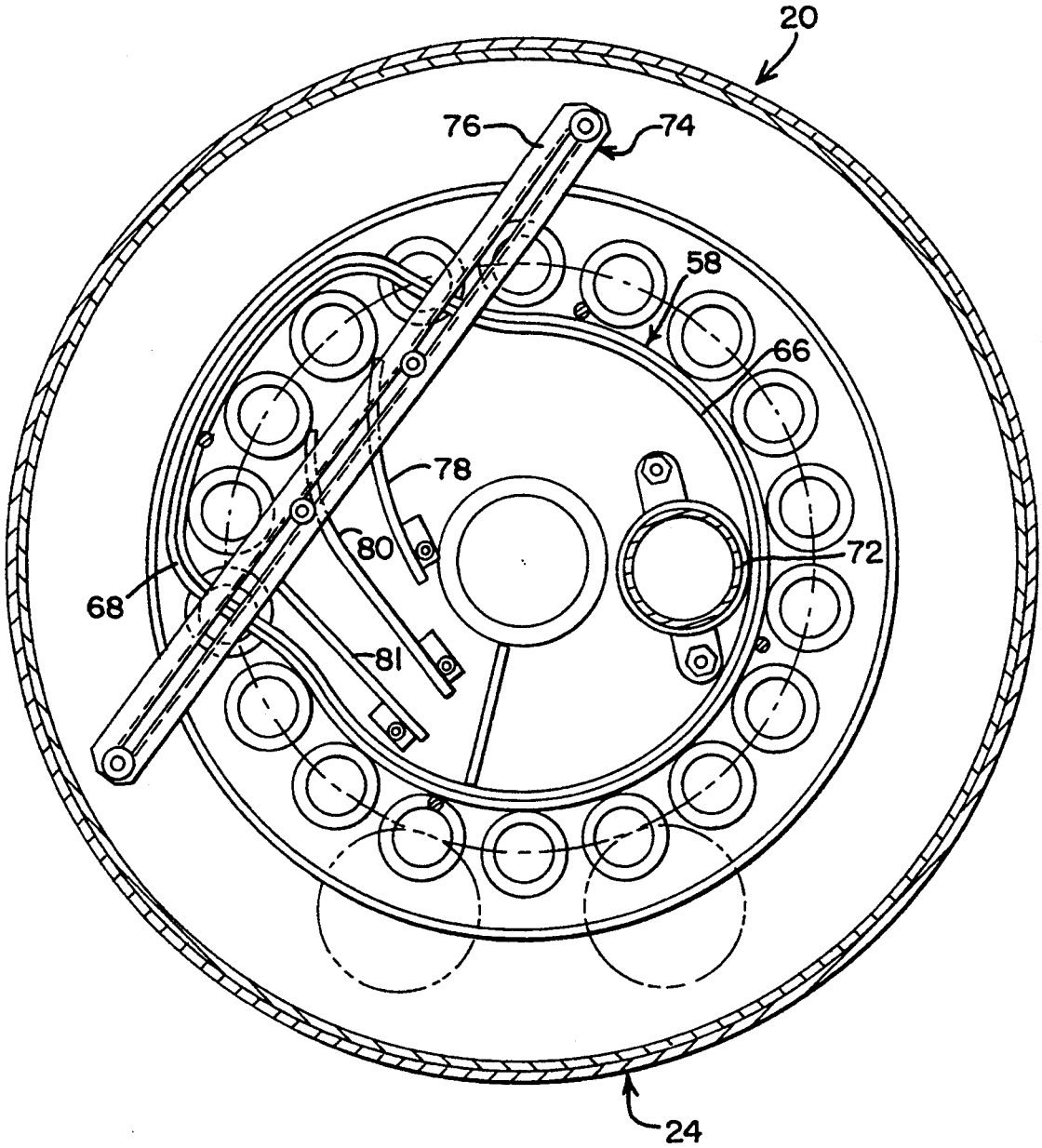
FIG. 6 is a top view of the filling machine of FIG. 1.
Figure 7:
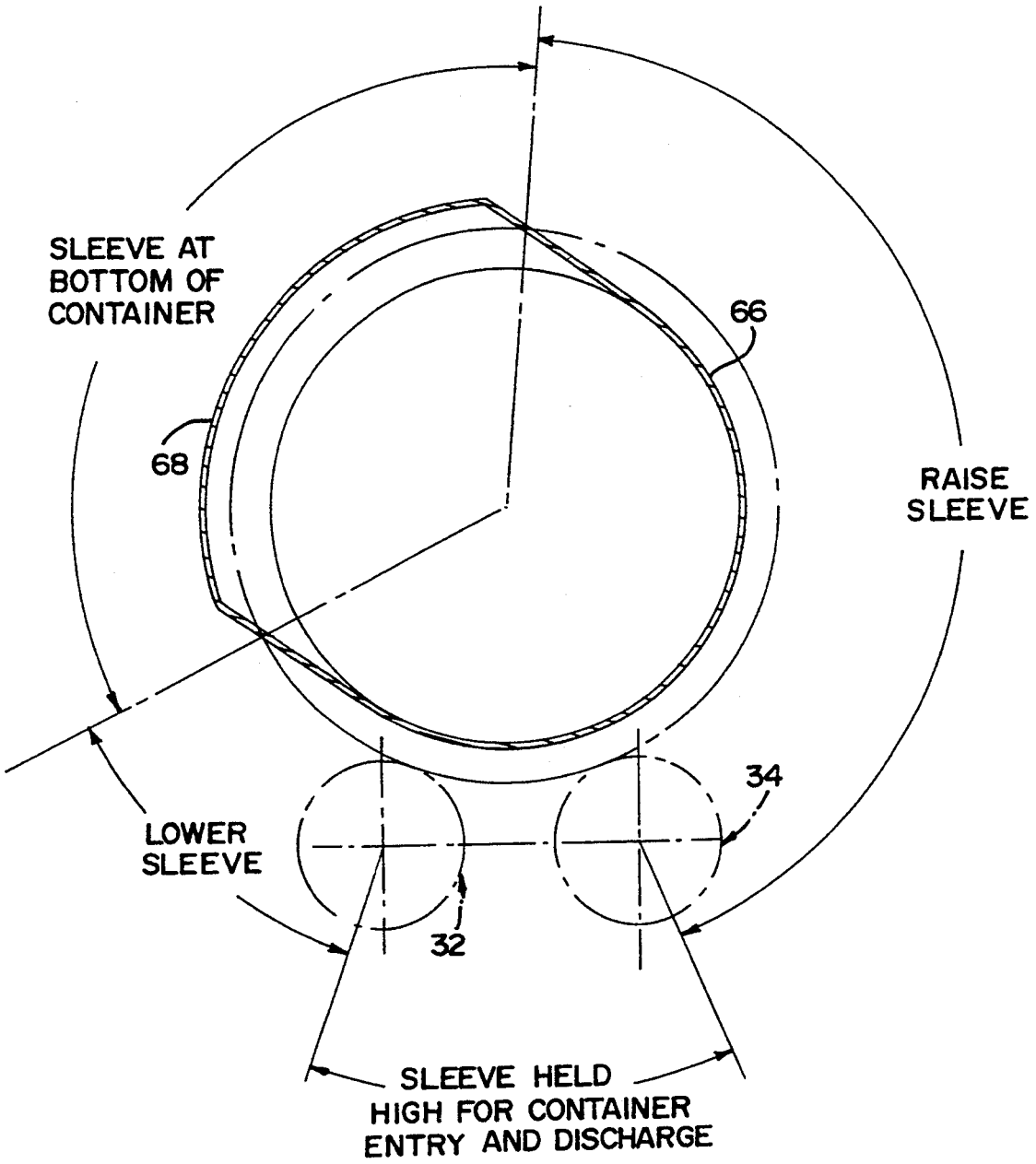
FIG. 7 is a diagramic drawing showing the sequence of the operation of the sleeve of each measuring flask as it moves through its circular path about a vertical axis.

The filling turret includes a filling tank 58 connected to the machine housing 24. The filling tank includes a rotatable tank floor 60 which rotates with drive shaft 52. Drive shaft 52 provides a vertical axis about which tank floor 60 rotates. Tank floor 60 includes a plurality of measuring flask apertures 62, which are arranged in a circle concentric with the axis of rotation of floor 60. The filling tank includes a retainer 64 which has its lower edge in sliding engagement with floor 60. The retainer 64 includes a central loop 66 and a filling loop 68, as viewed in FIG. 6. The retainer 64 is supported on the housing 24 by a plurality of support assemblies 70, which are secured to roof 71 of the housing. An inlet tube 72 is mounted in the roof. The inlet tube is connected to source of divided matter which is not shown herein. The filling tank assembly also includes a product guide assembly 74. A conventional rod 76 is connected to the housing. Vanes 78 and 80 are connected to the rod for directing divided material, as is conventional, and a vane 81 is secured to the roof.

A measuring flask 82 is mounted in each of the measuring flask apertures. Each measuring flask is identical to each other measuring flask. Each measuring flask includes an elongated open ended thin wall cylindrical stainless steel measuring tube 84 positioned in a respective aperture 62. Each tube 84 has a flange 86 formed integral therewith. The flange is positioned near the upper end of the tube. Tube 84 has its upper end open and communicates with the filling tank assembly. Tube 84 has its lower end open. The tube is mounted vertically and is aligned with the axis of rotation of floor 60. A mounting ring 88 is connected to floor 60 by a conventional spring clamp (not shown) to hold each tube 84 in its respective aperture 62. The measuring flask, in this instance, includes a high impact strength plastic right circular cylindrical sleeve 90; however, any other suitable material, such as, polyurethane or steel, may be used for the sleeve. Sleeve 90 is concentric with tube 84 and is telescopically mounted on the tube to move freely along the length of the tube. The sleeve is light weight to facilitate movement of the sleeve along the tube. The bottom portion of sleeve 90 is engageable with dome bottom 40 of its respective container 22.

Figure 2:
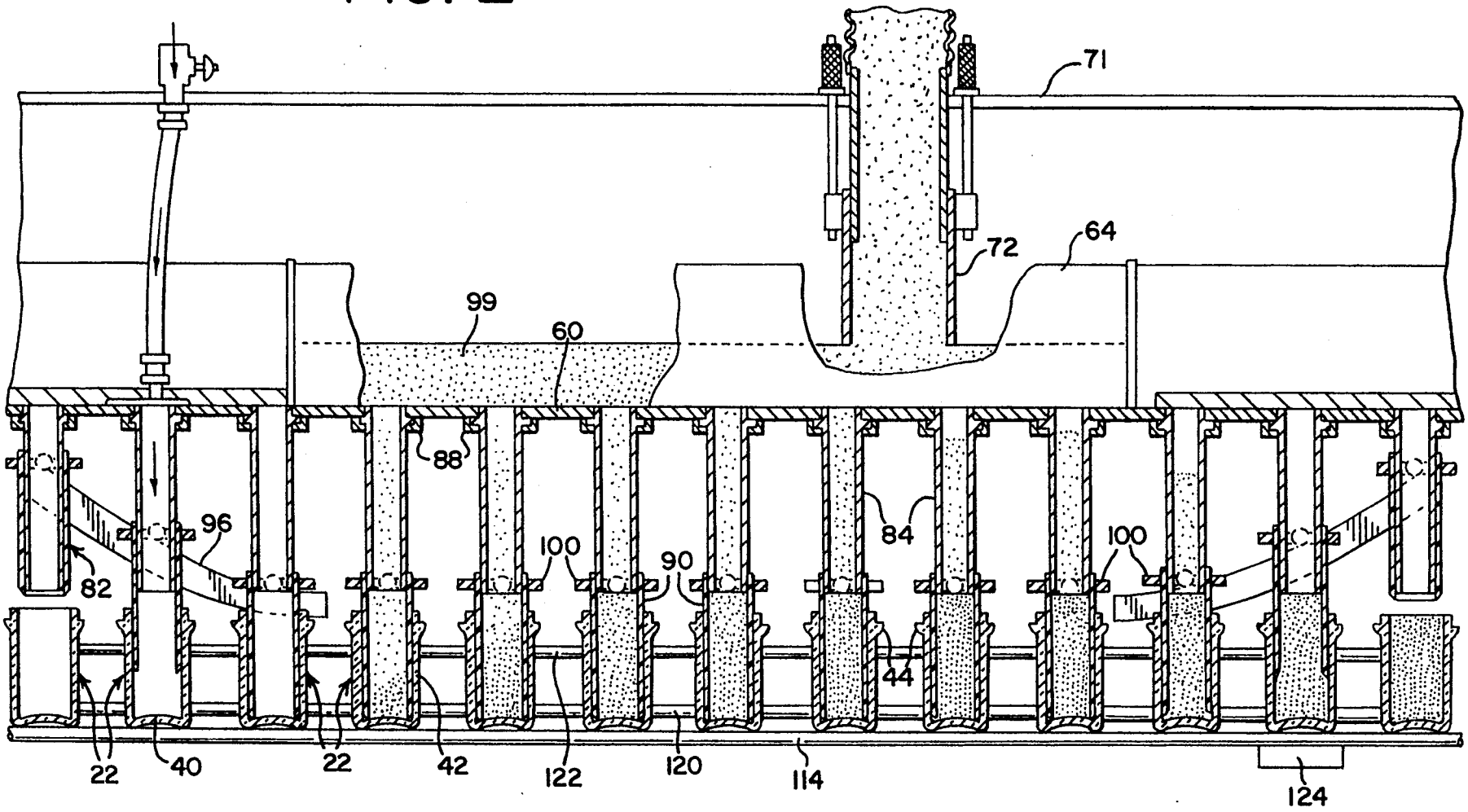
FIG. 2 is a cross sectional view through stations of the filling machines of FIG. 1, but laid out flat in order to show the attitude of each measuring flask relative to the respective container at each filling station.
Figure 5:
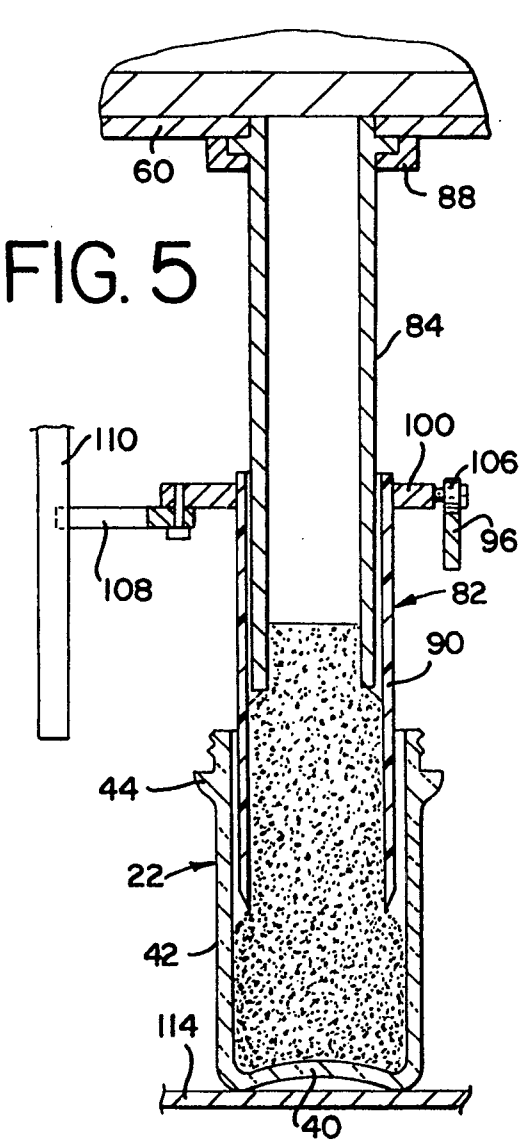
FIG. 5 is an enlarged cross sectional view similar to FIG. 4, but showing a sleeve of the measuring flask in a partially raised attitude discharging divided matter into the respective container.
Figure 4:
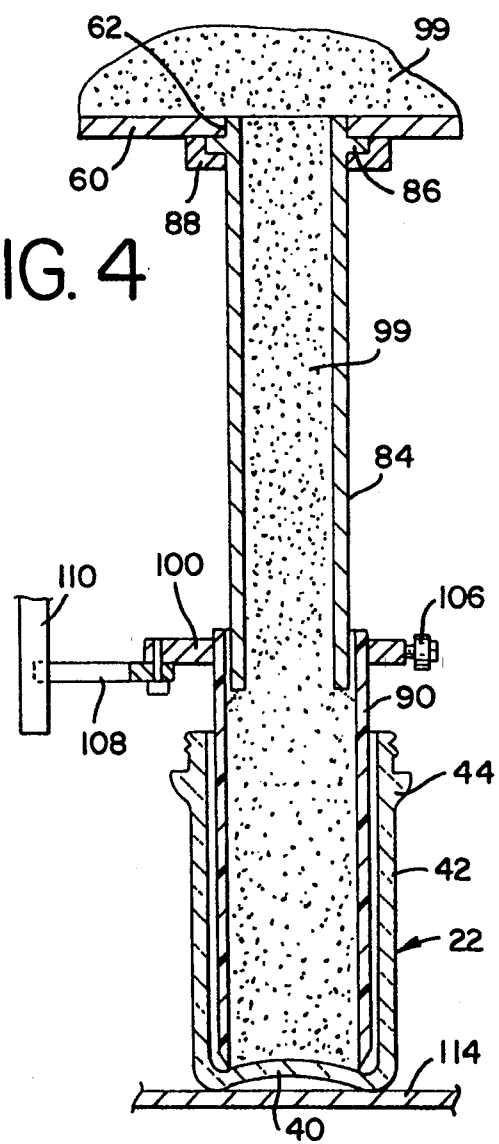
FIG. 4 is an enlarged cross sectional view similar to FIG. 3, but showing the measuring flask filled with divided matter.
Figure 3:
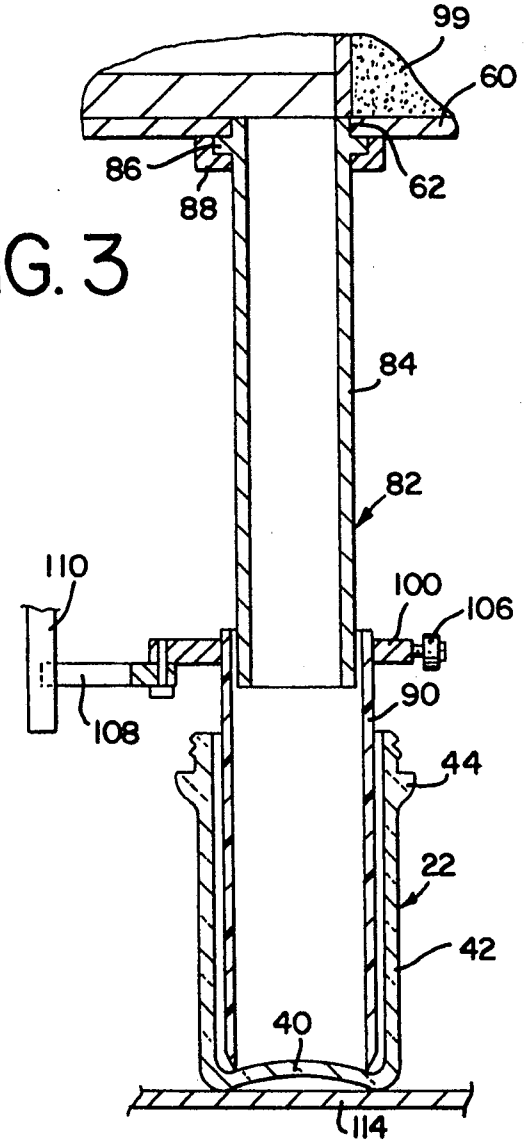
FIG. 3 is an enlarged cross sectional view of a container at one of the stations prior to introduction of divided matter into the measuring flask.

Each of the sleeves 90 is connected to control means 92, which selectively moves each sleeve relative to its respective tube 84 in an axial direction and thereby moves the sleeve relative to its respective container 22. Each sleeve is also connected to a sleeve guide 94 which prevents the sleeve from rotating relative to its respective tube and thereby maintains the connection of the sleeve with control means 92. Control means 92 includes an elongated cam 96, which is connected to housing 24 by a plurality of brackets 98. Cam 96, as may be best seen in FIG. 2, holds the sleeve in a raised position when the respective container is first delivered to the measuring flask. Then, the cam allows the sleeve to descent along its respective tube until the sleeve engages the bottom of its respective container, as shown in FIG. 3. The measuring flask is moved into alignment with the filling loop, so that the divided material flows into the measuring flask, as shown in FIG. 4. Further movement of the container places the container in the position shown in FIG. 5. The sleeve is raised by the cam to discharge the material into the container and to raise the sleeve above the container so that the container may be discharged onto the output conveyor.

Each sleeve has a radially outwardly extending sleeve split ring 100 mounted thereon adjacent to the upper end of the sleeve. Each ring 100 has a follower assembly 102 mounted thereon. Each follower assembly includes an axel 104 with a roller 106 rotatably mounted thereon. Roller 106 rotatably engages elongated cam 96, so that as the sleeve moves relative to the elongated cam, the sleeve moves vertically and axially relative to its respective tube.

Sleeve guide 94 includes a wish bone guide 108 fixed to split ring 100. A guide strap 110 is slidably mounted in wish bone guide 108. The guide strap 110 is fixed in U-mount 112 which is fixed to turret 28. The wish bone guide 108 riding in vertical strap 110 allows the sleeve to move vertically relative to is respective tube, but prevents the sleeve from rotating relative to its respective tube, thereby keeping roller 106 in engagement with the elongated cam.

A container support holds containers 22 in a single horizontal plane. The container support includes a support rail 114 which is fixed to a support rail bracket 116. Bracket 116 is fixed to drum 56. A container pocket 118 is mounted on the rotatable turret to move the container with rail 114. Outside rails 120 and 122 are connected to the housing, which rails 120 and 122 hold the container in its respective container pocket.

Infeed conveyor 30 delivers containers 22 to infeed turret 32 of the subject filling machine. The rotation of the infeed turret is synchronized with the rotation of the filling turret. The infeed turret carries each container onto rail 114 and into its respective pocket 118. Each container is then moved to a position where rails 120 and 122 keep the container in the pocket. The pocket is aligned with the respective measuring flask so that as the drum rotates, follower 106 goes down along lowering means portion 107 of the elongated cam 96. The follower is held into engagement with the cam by gravity so that other mechanical contrivances are not necessary. Each container moves in a circular path having its center at the axis of rotation of shaft 52.

Movement of each container from the discharge side of the infeed turret places the sleeve on a circular path having the same center as the center of the rotation of the filling tank assembly. Continued movement of each container keeps the container on the same horizontal plane. However, the sleeve follows the elongated cam. The cam extends downward. The movement of the sleeve is restricted to a strict vertical movement along the axis of its tube so that the cam roller is maintained in contact with the elongated cam. The elongated cam continues to allow the sleeve to move downward until the sleeve engages the bottom of the container, as may be seen in FIG. 2. Once the sleeve is at the bottom of the container, the respective measuring flask passes beneath the filling tank assembly, so that granular material or divided matter 99 flows into the tube and into the sleeve. The respective tube and the sleeve cooperate to effect measurement of the volume of granular material which is introduced into each container. Continued movement of the container and the filling flask causes the filling flask to leave filling loop 68. Further movement of the filling flask along the cam moves the cam follower to a position to engage the elongated cam and thereby raise the sleeve out of the container. The raising of the sleeve relative to the tube allows the granular material to fall out of the sleeve and the tube into the container. A conventional scale 124 is mounted adjacent to support rail 114 and moves with the drum. There are three such scales equiangularly spaced along rail 114 around the drum. The scales monitor the amount of divided matter delivered into each supported container at each of the three positions. The sleeve is raised out of each container so that each container may be picked up by the output turret and delivered to output conveyor 36. The instant construction provides a means wherein the metal tube and the plastic sleeve cooperate to provide a volumetric measuring device for use with granular material. When it is desired to make an adjustment of the amount of granular material delivered to each container, it is only necessary to move floor 60 relative to the support rail 114, thereby effecting an adjustment of the volume of material delivered to each of the containers 22. The maintenance of the containers 22 on the same horizontal plane allows the machine to operate at a high rate and the containers are given gentle handling.

Although a specific embodiment of the herein disclosed invention has been described in detail above, it is readily apparent that those skilled in the art may make various modifications and changes in the subject filling machine without departing from the spirit and scope of the present invention. The instant invention is limited only by the appended claims.

What is claimed is:

1. In an apparatus for filling like containers, each having a bottom and an upwardly extending continuous sidewall connected to the bottom, with a like measured amount of divided matter including, an apparatus housing, a drive connected to the housing, a filling turret mounted in said housing, said filling turret having a rotatable portion connected to said drive, said rotatable portion being rotated by said drive about a substantially vertical axis, said filling turret including a filling tank, said filling tank having a rotatable floor connected to said drive, said rotatable floor rotating with said rotatable portion of the filling turret, a plurality of measuring flasks arranged in a circle having its center at said vertical axis, said measuring flasks connected to said rotatable floor of the filling tank; the improvement comprising; each of said measuring flasks including an open ended elongated measuring tube having one end connected to the rotatable floor for receiving divided matter from the filling tank and the other end of the tube extending downward, each tube having its length substantially parallel to said vertical axis, a sleeve telescopically mounted on each open ended measuring tube and being movable axially along the length of its respective tube, a container support mounted in said housing below the measuring flasks, said container support being in a substantially horizontal plane, said container support adapted for holding a plurality of containers on substantially the same level, means for aligning each of said containers with a respective a sleeve and moving the containers on the container support in a circular path, said circular path having its center at the vertical axis, control means positioning each sleeve relative to a respective container while the container moves in the circular path in a horizontal plane about said vertical axis, said control means including means holding each sleeve in a raised position above the respective container during movement of the container in a selected portion of said circular path, said control means including lowering means for lowering each sleeve into its respective container during movement of the container in another selected portion of said circular path, and said control means including means raising each sleeve out of the respective container during movement of the container in still another selected portion of said circular path.

2. In an apparatus for filling like containers, each having a bottom and an upwardly extending continuous sidewall connected to the bottom, with a like measured amount of divided matter including, an apparatus housing, a drive connected to the housing, a filling turret mounted in said housing, said filling turret having a rotatable portion connected to said drive, said rotatable portion being rotated by said drive about a substantially vertical axis, said filling turret including a filling tank, said filling tank having a rotatable floor connected to said drive, said rotatable floor rotating with said rotatable portion of the filling turret, a plurality of measuring flasks arranged in a circle having its center at said vertical axis, said measuring flasks connected to said rotatable floor of the filling tank; the improvement as defined in claim 1, wherein each tube is thin wall right circular cylinder, and each sleeve is right circular cylinder concentric with its respective tube.

3. In an apparatus for filling like containers, each having a bottom and an upwardly extending continuous sidewall connected to the bottom, with a like measured amount of divided matter including, an apparatus housing, a drive connected to the housing, a filling turret mounted in said housing, said filling turret having a rotatable portion connected to said drive, said rotatable portion being rotated by said drive about a substantially vertical axis, said filling turret including a filling tank, said filling tank having a rotatable floor connected to said drive, said rotatable floor rotating with said rotatable portion of the filling turret, a plurality of measuring flasks arranged in a circle having its center at said vertical axis, said measuring flasks connected to said rotatable floor of the filling tank; the improvement as defined in claim 1, wherein said lowering means for lowering the sleeve into the respective container allows the sleeve to engage the bottom of the respective container.

4. In an apparatus for filling like containers, each having a bottom and an upwardly extending continuous sidewall connected to the bottom, with a like measured amount of divided matter including, an apparatus housing, a drive connected to the housing, a filling turret mounted in said housing, said filling turret having a rotatable portion connected to said drive, said rotatable portion being rotated by said drive about a substantially vertical axis, said filling turret including a filling tank, said filling tank having a rotatable floor connected to said drive, said rotatable floor rotating with said rotatable portion of the filling turret, a plurality of measuring flasks arranged in a circle having its center at said vertical axis, said measuring flasks connected to said rotatable floor of the filling tank; the improvement as defined in claim 1, including a radially outwardly extending cam follower mounted on each sleeve, each cam follower engageable with the control means and gravity urges the cam follower to follow the control means in a vertical direction.

5. In an apparatus for filling like containers, each having a bottom and an upwardly extending continuous sidewall connected to the bottom, with a like measured amount of divided matter including, an apparatus housing, a drive connected to the housing, a filling turret mounted in said housing, said filling turret having a rotatable portion connected to said drive, said rotatable portion being rotated by said drive about a substantially vertical axis, said filling turret including a filling tank, said filling tank having a rotatable floor connected to said drive, said rotatable floor rotating with said rotatable portion of the filling turret, a plurality of measuring flasks arranged in a circle having its center at said vertical axis, said measuring flasks connected to said rotatable floor of the filling tank; the improvement as defined in claim 1, wherein the control means includes an elongated cam being a portion of a circle having its center at said vertical axis, said elongated cam connectable to each sleeve to control the upward and downward movement of each sleeve.

6. In an apparatus for filling like containers, each having a bottom and an upwardly extending continuous sidewall connected to the bottom, with a like measured amount of divided matter including, an apparatus housing, a drive connected to the housing, a filling turret mounted in said housing, said filling turret having a rotatable portion connected to said drive, said rotatable portion being rotated by said drive about a substantially vertical axis, said filling turret including a filling tank, said filling tank having a rotatable floor connected to said drive, said rotatable floor rotating with said rotatable portion of the filling turret, a plurality of measuring flasks arranged in a circle having its center at said vertical axis, said measuring flasks connected to said rotatable floor of the filling tank; the improvement as defined in claim 1, including a scale supporting a container and being adapted for measuring the amount of divided matter delivered into the container.

7. In an apparatus for filling like containers, each having a bottom and an upwardly extending continuous sidewall connected to the bottom, with a like measured amount of divided matter including, an apparatus housing, a drive connected to the housing, a filling turret mounted in said housing, said filling turret having a rotatable portion connected to said drive, said rotatable portion being rotated by said drive about a substantially vertical axis, said filling turret including a filling tank, said filling tank having a rotatable floor connected to said drive, said rotatable floor rotating with said rotatable portion of the filling turret, a plurality of measuring flasks arranged in a circle having its center at said vertical axis, said measuring flasks connected to said rotatable floor of the filling tank; the improvement as defined in claim 1, including a sleeve guide connected to each sleeve limiting movement of each sleeve relative to its respective tube to an axial movement along the length of the tube.

8. In an apparatus for filling like containers, each having a bottom and an upwardly extending continuous sidewall connected to the bottom, with a like measured amount of divided matter including, an apparatus housing, a drive connected to the housing, a filling turret mounted in said housing, said filling turret having a rotatable portion connected to said drive, said rotatable portion being rotated by said drive about a substantially vertical axis, said filling turret including a filling tank, said filling tank having a rotatable floor connected to said drive, said rotatable floor rotating with said rotatable portion of the filling turret, a plurality of measuring flasks arranged in a circle having its center at said vertical axis, said measuring flasks connected to said rotatable floor of the filling tank; the improvement as defined in claim 1, wherein each tube is a thin wall right circular cylinder, each sleeve is a right circular cylinder concentric with its respective tube, and said lowering means for lowering each sleeve into its respective container allows the sleeve to engage the bottom of the respective container.

9. In an apparatus for filling like containers, each having a bottom and an upwardly extending continuous sidewall connected to the bottom, with a like measured amount of divided matter including, an apparatus housing, a drive connected to the housing, a filling turret mounted in said housing, said filling turret having a rotatable portion connected to said drive, said rotatable portion being rotated by said drive about a substantially vertical axis, said filling turret including a filling tank, said filling tank having a rotatable floor connected to said drive, said rotatable floor rotating with said rotatable portion of the filling turret, a plurality of measuring flasks arranged in a circle having its center at said vertical axis, said measuring flasks connected to said rotatable floor of the filling tank; the improvement as defined in claim 1, including a radially outwardly extending ring mounted on each sleeve, each ring having a cam follower engageable with the control means, each tube is a thin wall right circular cylinder, and each sleeve is right circular cylinder concentric with its respective tube.

10. In an apparatus for filling like containers, each having a bottom and an upwardly extending continuous sidewall connected to the bottom, with a like measured amount of divided matter including, an apparatus housing, a drive connected to the housing, a filling turret mounted in said housing, said filling turret having a rotatable portion connected to said drive, said rotatable portion being rotated by said drive about a substantially vertical axis, said filling turret including a filling tank, said filling tank having a rotatable floor connected to said drive, said rotatable floor rotating with said rotatable portion of the filling turret, a plurality of measuring flasks arranged in a circle having its center at said vertical axis, said measuring flasks connected to said rotatable floor of the filling tank; the improvement as defined in claim 1, wherein each tube is a thin wall right circular cylinder, each sleeve is concentric with its respective tube, and said control means includes an elongated cam connectable to each sleeve to control the vertical movement of each sleeve relative to the respective tube of each sleeve.

11. In an apparatus for filling like containers, each having a bottom and an upwardly extending continuous sidewall connected to the bottom, with a like measured amount of divided matter including, an apparatus housing, a drive connected to the housing, a filling turret mounted in said housing, said filling turret having a rotatable portion connected to said drive, said rotatable portion being rotated by said drive about a substantially vertical axis, said filling turret including a filling tank, said filling tank having a rotatable floor connected to said drive, said rotatable floor rotating with said rotatable portion of the filling turret, a plurality of measuring flasks arranged in a circle having its center at said vertical axis, said measuring flasks connected to said rotatable floor of the filling tank; the improvement as defined in claim 1, wherein each tube is a thin wall right circular cylinder, each sleeve is concentric with its respective tube and being in sliding engagement therewith, and a scale supporting a supported container for measuring the amount of divided matter delivered into the supported container.

12. In an apparatus for filling like containers, each having a bottom and an upwardly extending continuous sidewall connected to the bottom, with a like measured amount of divided matter including, an apparatus housing, a drive connected to the housing, a filling turret mounted in said housing, said filling turret having a rotatable portion connected to said drive, said rotatable portion being rotated by said drive about a substantially vertical axis, said filling turret including a filling tank, said filling tank having a rotatable floor connected to said drive, said rotatable floor rotating with said rotatable portion of the filling turret, a plurality of measuring flasks arranged in a circle having its center at said vertical axis, said measuring flasks connected to said rotatable floor of the filling tank; the improvement as defined in claim 1, including a radially outwardly extending cam follower mounted on each sleeve, each cam follower engageable with the control means, and said lowering means for lowering each sleeve into the respective container allows the sleeve to engage the bottom of the respective container.

13. In an apparatus for filling like containers, each having a bottom and an upwardly extending continuous sidewall connected to the bottom, with a like measured amount of divided matter including, an apparatus housing, a drive connected to the housing, a filling turret mounted in said housing, said filling turret having a rotatable portion connected to said drive, said rotatable portion being rotated by said drive about a substantially vertical axis, said filling turret including a filling tank, said filling tank having a rotatable floor connected to said drive, said rotatable floor rotating with said rotatable portion of the filling turret, a plurality of measuring flasks arranged in a circle having its center at said vertical axis, said measuring flasks connected to said rotatable floor of the filling tank; the improvement as defined in claim 1, said control means includes an elongated cam connectable to each sleeve to control the vertical movement of each sleeve relative to its respective tube, said cam allows each sleeve to engage the bottom of its respective container.

14. In an apparatus for filling like containers, each having a bottom and an upwardly extending continuous sidewall connected to the bottom, with a like measured amount of divided matter including, an apparatus housing, a drive connected to the housing, a filling turret mounted in said housing, said filling turret having a rotatable portion connected to said drive, said rotatable portion being rotated by said drive about a substantially vertical axis, said filling turret including a filling tank, said filling tank having a rotatable floor connected to said drive, said rotatable floor rotating with said rotatable portion of the filling turret, a plurality of measuring flasks arranged in a circle having its center at said vertical axis, said measuring flasks connected to said rotatable floor of the filling tank; the improvement as defined in claim 1, including a scale supporting a supported container of the plurality of containers for measuring the amount of divided matter delivered into the supported container, and said lowering means for lowering each sleeve into the container allows vertical movement of the sleeve relative to the tube to allow the sleeve to engage the bottom of the container.

15. In an apparatus for filling like containers, each having a bottom and an upwardly extending continuous sidewall connected to the bottom, with a like measured amount of divided matter including, an apparatus housing, a drive connected to the housing, a filling turret mounted in said housing, said filling turret having a rotatable portion connected to said drive, said rotatable portion being rotated by said drive about a substantially vertical axis, said filling turret including a filling tank, said filling tank having a rotatable floor connected to said drive, said rotatable floor rotating with said rotatable portion of the filling turret, a plurality of measuring flasks arranged in a circle having its center at said vertical axis, said measuring flasks connected to said rotatable floor of the filling tank; the improvement as defined in claim 1, wherein the control means includes an elongated cam adapted to be connected to each sleeve to control the vertical movement of each sleeve relative to its respective tube, and each sleeve includes a radially outwardly extending cam follower engageable with the cam to ride along the cam for controlling vertical movement of each sleeve relative to its respective tube.

16. In an apparatus for filling like containers, each having a bottom and an upwardly extending continuous sidewall connected to the bottom, with a like measured amount of divided matter including, an apparatus housing, a drive connected to the housing, a filling turret mounted in said housing, said filling turret having a rotatable portion connected to said drive, said rotatable portion being rotated by said drive about a substantially vertical axis, said filling turret including a filling tank, said filling tank having a rotatable floor connected to said drive, said rotatable floor rotating with said rotatable portion of the filling turret, a plurality of measuring flasks arranged in a circle having its center at said vertical axis, said measuring flasks connected to said rotatable floor of the filling tank; the improvement as defined in claim 1, including a scale supporting a supported container for measuring the amount of divided matter delivered into the supported container, and a radially outwardly extending cam follower mounted on each sleeve, each cam follower is engageable with the control means, whereby lowering of the sleeve is effected by the cam follower riding on the control means.

17. In an apparatus for filling like containers, each having a bottom and an upwardly extending continuous sidewall connected to the bottom, with a like measured amount of divided matter including, an apparatus housing, a drive connected to the housing, a filling turret mounted in said housing, said filling turret having a rotatable portion connected to said drive, said rotatable portion being rotated by said drive about a substantially vertical axis, said filling turret including a filling tank, said filling tank having a rotatable floor connected to said drive, said rotatable floor, rotating with said rotatable portion of the filling turret, a plurality of measuring flasks arranged in a circle having its center at said vertical axis, said measuring flasks connected to said rotatable floor of the filling tank; the improvement as defined in claim 1, wherein the control means includes an elongated cam positioned above a portion of the container support, said cam connectable to each sleeve to control the vertical movement of each sleeve relative to its respective tube, and a scale supporting a supported container for measuring the amount of divided matter delivered into the supported container.

18. In an apparatus for filling like containers, each having a bottom and an upwardly extending continuous sidewall connected to the bottom, with a like measured amount of divided matter including, an apparatus housing, a drive connected to the housing, a filling turret mounted in said housing, said filling turret having a rotatable portion connected to said drive, said rotatable portion being rotated by said drive about a substantially vertical axis, said filling turret including a filling tank, said filling tank having a rotatable floor connected to said drive, said rotatable floor rotating with said rotatable portion of the filling turret, a plurality of measuring flasks arranged in a circle having its center at said vertical axis, said measuring flasks connected to said rotatable floor of the filling tank; the improvement as defined in claim 1, wherein each tube is a thin wall right circular cylinder, each sleeve is concentric with its respective tube, said control means includes an elongated cam, and a cam follower connected to each sleeve, each cam follower engageable with the elongated cam to control vertical movement of the respective sleeve relative to its respective tube.

19. In an apparatus for filling like containers, each having a bottom and an upwardly extending continuous sidewall connected to the bottom, with a like measured amount of divided matter including, an apparatus housing, a drive connected to the housing, a filling turret mounted in said housing, said filling turret having a rotatable portion connected to said drive, said rotatable portion being rotated by said drive about a substantially vertical axis, said filling turret including a filling tank, said filling tank having a rotatable floor connected to said drive, said rotatable floor rotating with said rotatable portion of the filling turret, a plurality of measuring flasks arranged in a circle having its center at said vertical axis, said measuring flasks connected to said rotatable floor of the filling tank; the improvement as defined in claim 1, including a radially outwardly extending cam follower mounted on each sleeve, and said control means includes an elongated cam engageable with the cam follower of each sleeve to control the vertical movement of the respective sleeve relative to its respective tube and to allow each sleeve to engage the bottom of its respective container.

20. In an apparatus for filling like containers, each having a bottom and an upwardly extending continuous sidewall connected to the bottom, with a like measured amount of divided matter including, an apparatus housing, a drive connected to the housing, a filling turret mounted in said housing, said filling turret having a rotatable portion connected to said drive, said rotatable portion being rotated by said drive about a substantially vertical axis, said filling turret including a filling tank, said filling tank having a rotatable floor connected to said drive, said rotatable floor rotating with said rotatable portion of the filling turret, a plurality of measuring flasks arranged in a circle having its center at said vertical axis, said measuring flasks connected to said rotatable floor of the filling tank; the improvement as defined in claim 1, including a scale supporting a supported container for selectively measuring the amount of divided matter delivered into the supported container, each tube is a thin wall right circular cylinder, each sleeve is made of plastic material and is concentric with its respective tube, said control means including an elongated cam formed as a portion of a circle having its center at the vertical axis, a cam follower mounted on each sleeve engageable with the elongated cam to control the vertical movement of the respective sleeve relative to its respective tube, and a sleeve guide connected to each sleeve limiting movement of each sleeve relative to its respective tube to an axial movement along the length of the respective tube, said cam allowing downward movement of each sleeve to engage the bottom of its respective container.

* * * * *